US006076537A

United States Patent [19]

Brink et al.

[11] Patent Number: 6,076,537

[45] Date of Patent: Jun. 20, 2000

[54] VACUUM EXTRACTION CLEANING SYSTEM

[75] Inventors: Christopher J. Brink; Eddie J. McChesney, both of Bowling Green, Ky.

[73] Assignee: Detrex Corporation, Bowling Green, Ky.

[21] Appl. No.: 09/050,851

[22] Filed: Mar. 30, 1998

[51] Int. Cl.[7] ..... B08B 3/04

[52] U.S. Cl. ..... 134/57 R; 134/95.2; 134/107; 134/109

[58] Field of Search ..... 134/104.2, 104.3, 134/105, 107, 108, 109, 111, 57 R, 95.2; 68/12.08, 12.09, 5

[56] References Cited

U.S. PATENT DOCUMENTS

| | | | |
|---|---|---|---|
| 3,801,274 | 4/1974 | Gleason | 8/142 |
| 4,252,546 | 2/1981 | Krugmann | 55/82 |
| 4,929,312 | 5/1990 | Westcott | 203/2 |
| 5,232,476 | 8/1993 | Grant | 55/42 |
| 5,304,253 | 4/1994 | Grant | 134/26 |
| 5,343,885 | 9/1994 | Grant | 134/105 |
| 5,423,921 | 6/1995 | Saal et al. | 134/26 |
| 5,586,456 | 12/1996 | Takagawa et al. | 68/18 R |
| 5,702,535 | 12/1997 | Gray et al. | 134/10 |
| 5,850,747 | 12/1998 | Roberts | 68/15 |
| 5,881,577 | 3/1999 | Sauer et al. | 68/5 |

OTHER PUBLICATIONS

Dürr Euroclean Brochure, Jan. 1997, Cleaning Machines of the Compact Class (Compact 82S, Compact 80W, Compact 80C), Wixom, MI.

Dürr Euroclean Brochure, Jan. 1997, Universal 81C, Wixom, MI.

Dürr Euroclean Brochure, Jan. 1997, Compact 80C, Wixom, MI.

*Primary Examiner*—Philip R. Coe

*Attorney, Agent, or Firm*—Harness, Dickey & Pierce, P.L.C.

[57] ABSTRACT

A pulse vacuum extraction solvent cleaning system in which solvent remnants are removed from a cleaning vessel by evacuating the closed cleaning vessel to a predetermined vacuum pressure. At the predetermined vacuum pressure, if the concentration of solvent exceeds a predetermined value, air is introduced into the cleaning vessel to reduce the vacuum pressure and provide a carrier to remove the solvent. The process repeats until the solvent concentration falls below a predetermined threshold.

8 Claims, 2 Drawing Sheets

VACUUM EXTRACTION CLEANING SYSTEM

BACKGROUND OF THE INVENTION

1. Field of the Invention

The present invention is directed to a solvent cleaning system and, more particularly, is directed to a pulse vacuum extraction system and methodology for removing solvent from a cleaning vessel.

2. Discussion

Organic solvents and cleaning agents are used in various types of vapor degreasing and defluxing equipment to clean articles of manufacturer, deflux electronic circuit boards, and the like. The organic solvents generally used are volatile organic solvents.

Solvents have been recognized to contribute to the global warming phenomenon. In view of these damaging effects on the environment from solvents venting into the atmosphere, alternative drying methods are required to lower atmospheric emissions and operator exposure. Alternative cleaning and recovery methods are generally more expensive. The traditional incentives to reduce vapor loses because of cost and safety were enhanced with the global warming phenomenon. With the use of these cleaning solvents, new parameters were required for various regions in the degreaser tank to minimize degradation of the tank by these solvents during the extraction or drying cycle.

As a consequence of the enhanced desire to reduce vapor loses, many solvent cleaning system manufacturers rely upon the use of closed vessel cleaning systems. In such systems, rather than relying upon an open vat, bath, or other vessel as a container for the cleaning solvent, from which various costly and unsafe vapors can escape, manufactures have increasingly turned to the use of the closed cleaning systems. The product to be cleaned is placed inside the closed vessel which is then flooded with cleaning solvent solution. The solvent solution is then circulated to clean the product. Following the circulation process, the liquid solution is removed from the vessel. After the liquid solvent has been removed from the vessel, some liquid solvent will remain within the vessel in and among the product to be cleaned. Conventionally, the product will be dried and the vessel may be emptied by evaporating the liquid solvent into a gas and evacuating the solvent in the gaseous state from the vessel. This removes the liquid solvent from the vessel and also drys the product.

In conventional closed solvent cleaning systems, drying the product and removing the solvent from the closed vessel is accomplished by creating a vacuum within the vessel. Creating a vacuum lowers the boiling point of the solvent so that the solvent effectively evaporates into a gas which may then be evacuated from the closed vessel. Present solvent cleaning systems attempt to create a perfect vacuum, approximately 30 inches of mercury (Hg), within the cleaning vessel. Such a deep vacuum has several adverse affects. First, a deep vacuum causes the solvent to boil and may cause premature breakdown of solvents with stabilizers or additives. The broken down solvent attacks the interior of the cleaning vessel, eventually requiring that the cleaning vessel to be replaced. Because cleaning vessels are rather costly, breaking down the solvent in this manner is undesirable. Solvent breakdown is enhanced if water is present in the solvent, further attacking the interior of the vessel. Second, it has been shown that while a deep vacuum may ensure evaporation of the liquid solvent, the evaporated solvent lacks sufficient density to travel across the vessel and be removed from the vessel. Even though the entirety of the solvent may be evaporated by using a deep vacuum, gas residue from the solvent often remains in the cleaning vessel because the solvent gas lacks sufficient density to be moved from the cleaning vessel. Residual solvent in a gaseous state also creates a safety issue. When the operator opens the cleaning vessel to remove the cleaned product and to insert new product to be cleaned, exhaust fans which are activated upon opening the vessel may cause the evaporated solvent to escape in the direction of the operator. This poses a possible health issue to the operator.

Thus, it is an object of the present invention to provide a closed solvent cleaning system for substantially removing all solvent from the closed vessel with minimum solvent breakdown.

SUMMARY OF THE INVENTION

This invention is directed to a solvent extraction and cleaning system including a generally closed vessel having a port for the introduction and extraction of solvent. The vessel is configured to allow introduction and removal of solvent. A reservoir stores the solvent and is connected to the vessel to enable transfer of solvent between the vessel and the reservoir. A pump creates a vacuum pressure within the vessel by drawing air through the vessel. A controller regulates the vacuum pressure within the vessel by monitoring the vacuum pressure within the vessel so that at a predetermined vacuum pressure, the controller temporarily enables gas to enter the vessel. The introduction of gas provides a carrier for evaporated solvent and reduces the vacuum pressure within the vessel. The controller sequentially enables the vacuum pressure to build and enables the evaporated gas to be removed from the vessel.

This invention is also directed to a method for cleaning product and recovering solvent in a cleaning system including the steps of introducing solvent into a vessel from a solvent reservoir and circulating solvent within the vessel to clean the product. Solvent is then drained from the vessel after circulating the solvent. A vacuum is then induced within the vessel to evaporate the solvent. At a predetermined vacuum pressure, air is introduced into the vessel to provide a carrier for evaporated gas and to reduce the vacuum below the predetermined threshold. A concentration of solvent is determined within the vessel. If the solvent concentration is above a predetermined threshold, a sequential sequence of inducing a vacuum and introducing air into the vessel to reduce the solvent concentration below a predetermined threshold is followed.

These and other advantages and features of the present invention will become readily apparent from the following detailed description, claims and drawings.

BRIEF DESCRIPTION OF THE DRAWINGS

The drawings, which form an integral part of the specification, are to be read in conjunction therewith, and like reference numerals are employed to designate identical components in the various views.

DETAILED DESCRIPTION OF THE PREFERRED EMBODIMENTS

Figure 1:
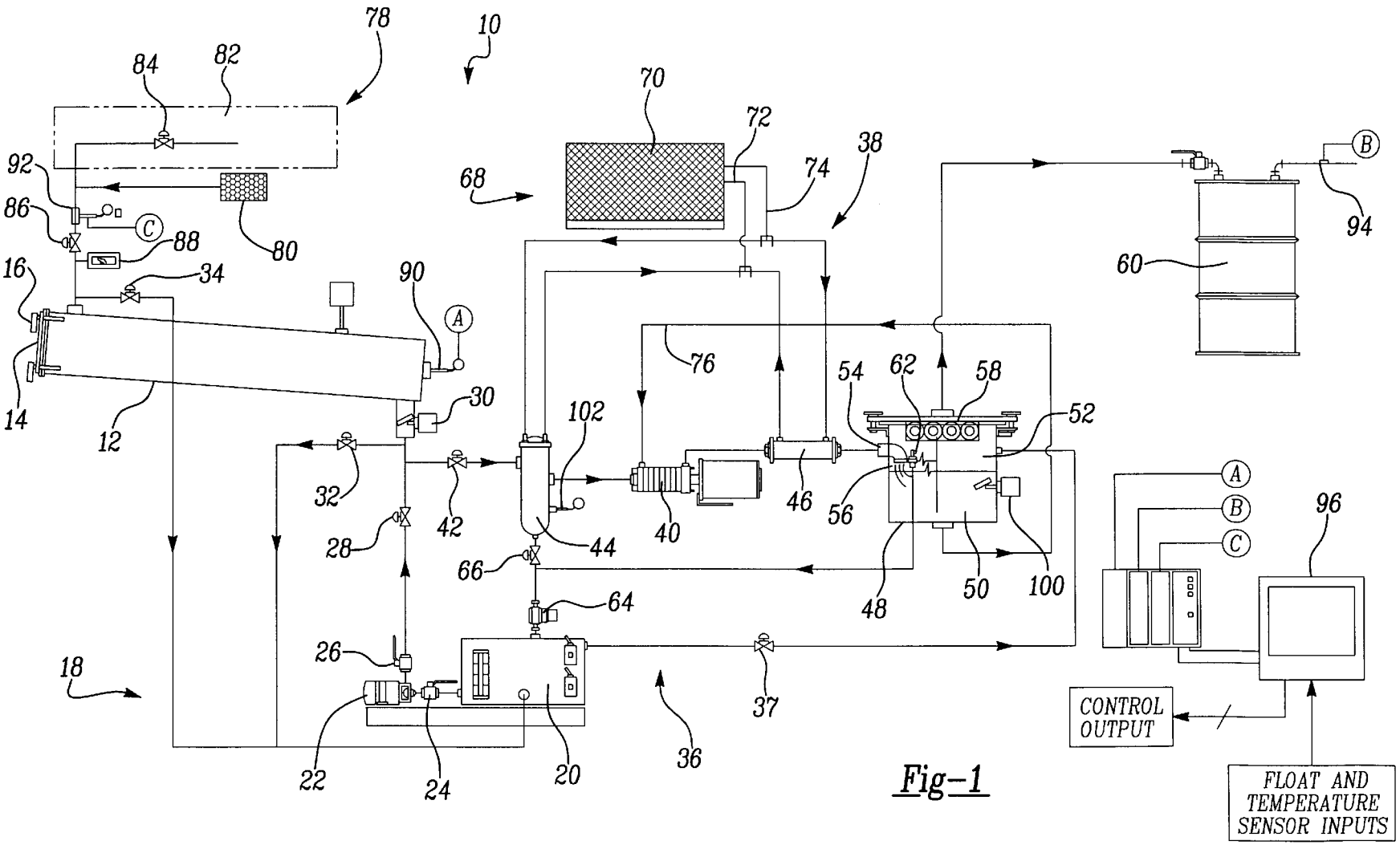
FIG. 1 depicts a schematic diagram of the pulse vacuum extraction solvent cleaning system arranged within accordance of the principals of the present invention.

FIG. 1 shows the solvent cleaning system 10 of the present invention. The solvent cleaning system 10 includes a cleaning vessel 12, which is a generally closed cleaning vessel. Cleaning vessel 12 includes an access door 14 which when open allows the insertion of product into cleaning vessel 12 and when closed sealingly engages cleaning vessel 12 to create a fluid seal. Access door 14 includes a pair of latches 16 to sealably engage access door 14 with cleaning vessel 12. Cleaning vessel 12 is inclined to facilitate a draining operation, as will be described.

Solvent cleaning system 10 includes a fluid solvent circuit 18. Fluid solvent circuit 18 is comprised of a solvent reservoir 20 which stores the cleaning solvent. A pump 22 is connected to solvent reservoir 20 through a valve 24. Pump 22 receives as input fluid from solvent reservoir 20 and outputs fluid at a pressure though valve 26, solenoid 28, and float sensor 30. Valves 24 and 26 are shown as manually operated valves which may used to inhibit fluid flow between solvent reservoir 20 and pump 22 and pump 22 and cleaning vessel 12, respectively.

Fluid solvent circuit 18 includes a pair of solvent return channels. A first solvent return channel returns solvent to solvent reservoir 20 through solenoid 28, and solenoid 32. This solvent return channel enables draining of cleaning vessel 12 into solvent reservoir 20, solvent as will be described further herein. A second solvent return channel returns solvent to solvent reservoir 20 from an upper end of cleaning vessel 12 through solenoid 34 to solvent reservoir 20. This fluid return channel is operable when cleaning vessel 12 becomes full during the filling cycle, fluid overflowing from cleaning vessel 12 exists the upper end of cleaning vessel 12 and passes though solenoid 34. Solvent cleaning system 10 also includes an air flow circuit 36 having a solenoid 37, the operation of which will be described further with respect to solvent evacuation system 38.

Solvent cleaning system 10 also includes a solvent evacuation system 38. Solvent evacuation system 38 includes a vacuum pump 40. Vacuum pump 40 is embodied herein as a liquid seal impeller, multi-stage pump. Vacuum pump 40 creates a vacuum in cleaning vessel 12 by drawing air through solenoid 42 and trap 44. Vacuum pump 40 exhausts air that passes through a heat exchanger 46 and into a separator 48. Separator 48 separates solvent in either a liquid or gas state from the exhaust air. Separator 48 includes a water layer 50 and an air layer 52. Exhaust air is forced downward by a nozzle 54 toward water layer 50. Water layer 50 enables separation of the solvent from the exhaust air, creating a solvent layer 56, which is in a liquid state. Solvent in a gaseous state resides in air layer 52 and is exhausted through a prescrubber 58 into a carbon filter 60.

Separator 48 includes an overflow valve 62 which resides at the top of solvent layer 56. Overflow valve 62 recovers solvent from solvent layer 56 by allowing the solvent to overflow to the solvent reservoir 20 through totalizing meter 64. Solvent may also be recovered from trap 44 and delivered to solvent reservoir 20 through solenoid 66 and totalizing meter 64, which monitors the volume of solvent returned to solvent reservoir 20.

Vacuum pump 40 draws air though trap 44. Trap 44 is embodied as a refrigerated trap which cools gases drawn through trap 44 to preferably a range of −20 to −40 degrees Fahrenheit. Accordingly, solvent evacuation system 38 includes a cooling system 68. Cooling system 68 includes a refrigeration unit 70 for reducing the temperature of fluid received through an input line 72 and output through output line 74. Cooling system 68 forms a closed fluid system in which output fluid from radiator 70 flows through output line 74, through trap 44 where it cools the gas within trap 44. The fluid exits trap 44 and is returned to refrigeration unit 70 through input line 72. Similarly, output fluid exits refrigeration unit 70 through output line 74 and is circulated through heat exchanger 46 in order to cool exhaust gas from vacuum pump 40. Fluid exiting heat exchanger 46 is returned to refrigeration unit 70 through input line 72.

Separator 48 also provides water to vacuum pump 40 to support operation to vacuum pump 40. Water drains out of the bottom of separator 48 and is input to vacuum pump through water line 76. Water is mixed with air exiting trap 44 and provides a vacuum seal to enable operation of vacuum pump 40. This water is then returned to separator 48 through heat exchanger 46, where it is separated from solvent.

Solvent cleaning system 10 also includes an air intake system 78. Air intake system generally comprises a fresh air intake and, for use with flammable solvents, a nitrogen mixer as well. The air intake includes a filter 80 to filter fresh air prior to introduction to cleaning vessel 12. A nitrogen intake system 82 may also be included for flammable solvents. Nitrogen is introduced through a solenoid 84. A solenoid 86 controls introduction of the air and/or nitrogen mixture to cleaning vessel 12.

The solvent cleaning system 10 includes several sensors and solenoids to control operation of the system. In particular, a vacuum switch 88 provides an output signal in accordance with the vacuum pressure within cleaning vessel 12. Three air sensors 90, 92, and 94 provide output to a controller 96 in accordance with the composition of the gas in proximity to the respective sensors. In particular, sensor 90 detects the parts per million (PPM) of solvent within cleaning vessel 12. Similarly, sensor 94 detects the PPM of solvent exiting carbon filter 60. Each sensor 90 and 94 outputs a signal to controller 96 which varies in accordance with the concentration of solvent in the sampled area. Similarly, oxygen sensor 94 determines the concentration of oxygen within the fresh air and nitrogen mix prior to induction to cleaning vessel 12. Oxygen sensor 94 outputs a signal which varies in accordance with the concentration of oxygen to controller 96.

Solvent cleaning system 10 also includes sensors for determining the vacuum within the solvent evacuation system 38. In particular, vacuum switch 88 outputs a signal to controller 96 which varies in accordance with the vacuum pressure within cleaning vessel 12. Further, an emergency vacuum break switch 98 is connected to cleaning vessel 12 and outputs a signal when the vacuum 12 exceeds a predetermined operating vacuum for cleaning vessel 12. Emergency vacuum break 98 enables introduction of ambient air when the vacuum pressure within cleaning vessel 12 exceeds a predetermined pressure.

Solvent cleaning system 10 also includes a pair of float sensors 30, and 100. Float sensor 30 outputs a signal that varies in accordance with the fluid level in cleaning vessel 12. Preferably, when cleaning vessel 12 is sufficiently drained, float sensor 30 provides an output signal indicating the same. Such signal may be used to control solenoid 32. Similarly, float sensor 100 outputs a signal varying in accordance with the level of water layer 50 in separator 48. Float sensor 100 provides an output signal to controller 96 which in turn deactivates vacuum pump 40 in situations where water level 50 falls below a predetermined level.

Further, a temperature sensor 102 is placed in trap 44 to determine the temperature of the gas within trap 44. Temperature sensor 102 outputs a signal to controller 96 that varies in accordance with the temperature of the gas in trap 44. Preferably, controller 96 deactivates vacuum pump 40 if the temperature within the trap 44 falls outside a predetermined range.

Controller 96 receives the above-described inputs and generates control signals to control operation of pump 40, vacuum pump 44, and the above-described solenoids, the particular operation of which will be described herein.

Figure 2:
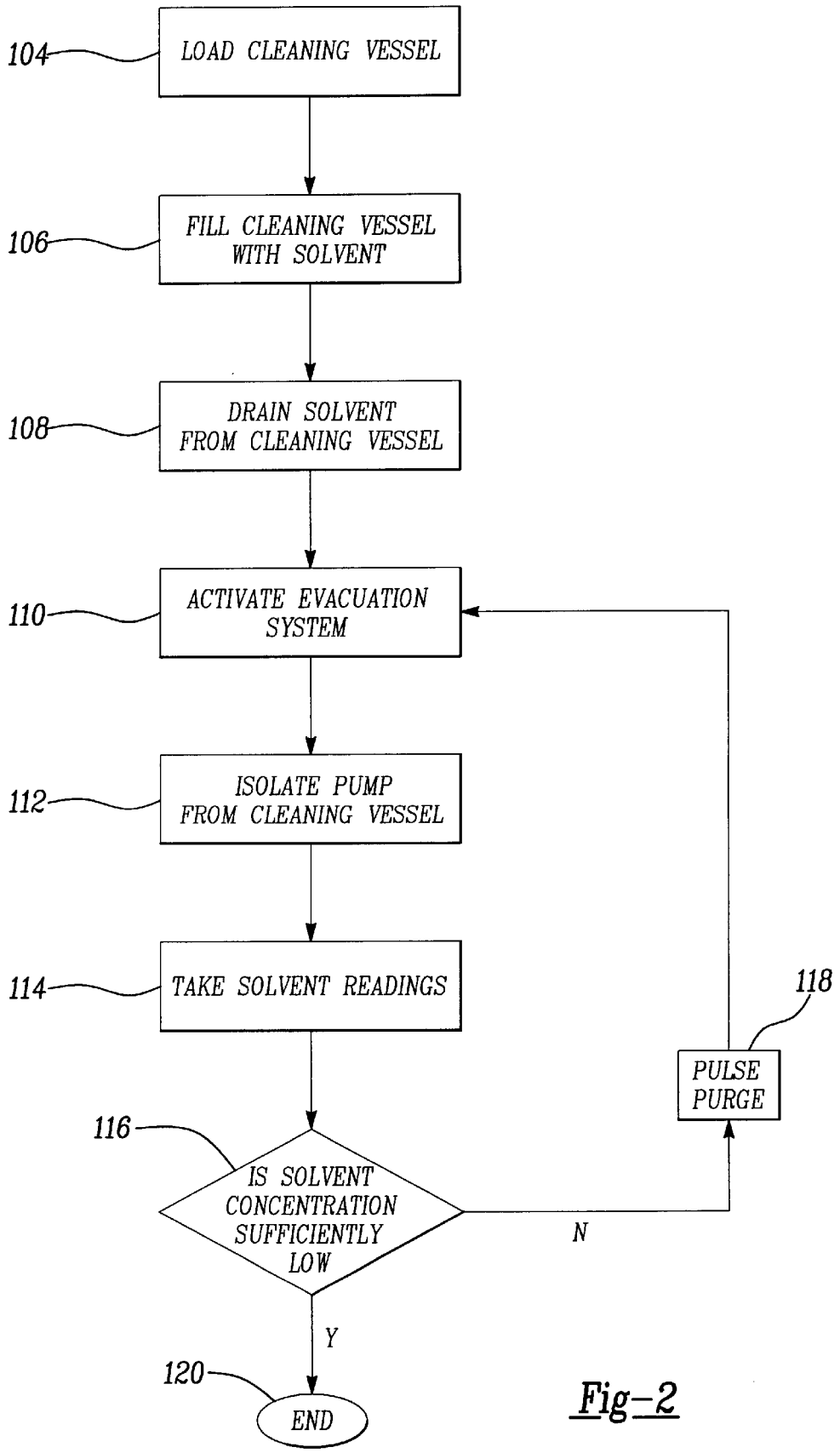
FIG. 2 depicts a flow diagram of the operation of the pulse vacuum extraction solvent cleaning system.

FIG. 2 depicts a flow diagram of the operation of the solvent cleaning system 10 of FIG. 1. Starting at block 104, parts are loaded into the cleaning vessel 12 and access door 14 is then closed to create an air tight seal within cleaning vessel 12. Control then proceeds to block 106 in which solvent is pumped from solvent reservoir 20 by pump 22 into cleaning vessel 12. Controller 96 enables the filling operation by opening solenoid 28 to fill cleaning vessel 12 and by opening solenoid 34 to provide an overflow return path from cleaning vessel 12 to solvent reservoir 20. Controller 96 also closes solenoids 32 and 86 to enable filing of cleaning vessel 12. Also during the filling operation, controller 96 opens solenoid 37 to enable solvent reservoir 20 to vent to air layer 52 of separator 48. The configuration of the solenoids in this manner enables continuous circulation of solvent through cleaning vessel 12 and solvent reservoir 20 in order to clean the product loaded within cleaning vessel 12.

After the cleaning process is complete, cleaning vessel 12 is drained of solvent as shown at block 108. In order to drain cleaning vessel 12, controller 96 deactivates pump 22 and closes solenoids 28 and 34. Controller 96 also opens solenoids 32 and 86 to enable solvent to drain from cleaning vessel 12 to solvent reservoir 20. After cleaning vessel 12 has been drained of solvent, solvent evacuation system 38 is activated in order to create a vacuum in cleaning vessel 12 to remove the solvent, thereby drying the product loaded into cleaning vessel 12, as show in block 110. Solvent evacuation system 38 is activated when controller 96 activates pump 40, opens solenoid 42 and closes solenoids 32 and 86, creating a vacuum in cleaning vessel 12 vacuum pump 40 normally remains activated. Vacuum pump 40 withdraws air from cleaning vessel 12 into trap 44 and exhausts air to separator 48 through heat exchanger 46. During step 110, vacuum sensor 88 outputs a signal which varies in accordance with the vacuum pressure within cleaning vessel 12.

At a predetermined vacuum pressure, controller 96 cuts off vacuum pressure to cleaning vessel 12 by closing solenoid 42, as shown at block 112. Controller 96 processes the output signal from PPM sensor 90 to determine the solvent concentration within cleaning vessel 12, as show at block 114. At block 116, a test is performed to determine if the solvent concentration measured by PPM sensor 90 is less than a predetermined concentration. If the concentration is not less than the predetermined level, a pulse purge step is initiated as show at block 118.

During pulse purge step 118, controller 96 opens solenoid 86 to enable air to enter into cleaning vessel 12. Control then returns to block 110 in which the vacuum system is operated as described above to again evacuate cleaning vessel 12. The interative steps of blocks 110, 112, 114, 116, and 118 repeat until the solvent concentration within cleaning vessel 12 is less than a predetermined value, as tested at block 116. When this test is met, control proceeds to block 120. At block 120, access door 14 may be opened so that the cleaned product may be removed from cleaning vessel 12 and new product to be cleaned may be inserted therein. When access door is opened solenoid 42 may be opened slightly to maintain an air flow into cleaning vessel 12.

Returning to block 110, during evacuation of cleaning vessel 12, evacuation system 38, in addition to removing solvent from cleaning vessel 12, operates to recover solvent for return for solvent reservoir 20. In particular, gases removed from cleaning vessel 12 are pulled into refrigerated trap 44 where they are cooled to −20 degrees to −40 degrees Fahrenheit. Preferably, the gas flow rate and density are predetermined in order to enable sufficient cooling of gasses pulled into trap 44. Liquid solvent recovered from trap 44 is directed to solvent reservoir 20 by opening solenoid 66. Gases exiting trap 44 are pulled through vacuum pump 40 and mixed with water provided on water line 76 from separator 48. Exhaust gas output by vacuum pump 44 passes through heat exchanger 46 where it is cooled and discharged into separator 48. Separation occurs due to differences in specific gravity between water layer 50 and solvent layer 56. The solvent layer 56 is collected by float valve 62 which directs solvent back to solvent reservoir 20 through totalizing meter 64. Toalizing meter 64 determines the amount of solvent returned from trap 44 and from separator 48.

As described above, an air layer 52 forms on top of solvent layer 56 and water layer 50 and is exhausted through prescrubber 58 to carbon filter 60, where it is exhausted to atmosphere. PPM sensor 94 measures the concentration of solvent within the gas exhausted from carbon filter 60. Output from PPM sensor 94 is input to controller 96. The output from PPM sensor 94 indicates when carbon filter 60 is saturated and requires replacement.

A particularly inventive feature of the present invention is initiation of pulse purge step 118 in order to sufficiently remove solvent from cleaning vessel 12. Through use of the pulse purse step 118, evacuation of cleaning vessel 12 to a deep vacuum, such as 30 inches of mercury, can be avoided. Avoiding a deep vacuum minimizes breakdown of the solvent into a gas which may be detrimental to the interior of cleaning vessel 12. At a predetermined vacuum, which is substantially less than 30 inches of mercury, if the concentration solvent within cleaning vessel 12 exceeds a predetermined level, air is introduced into cleaning vessel 12 through solenoid 86. The introduced air provides a carrier having sufficient density to carry solvent from cleaning vessel 12 to solvent reclamation circuit 36. The introduced air reduces the vacuum pressure, which is a departure from the prior art. Such pulse purging limits vacuum pressure within vacuum vessel 12 to a pressure sufficient to only cause solvent to change from a liquid to gaseous state. This vacuum pressure, however, avoids breakdown of the solvent into components that may be potentially harmful to the interior of cleaning vessel 12.

While specific embodiments have been shown and described in detail to illustrate the principles of the present invention, it will be understood that the invention may be embodied otherwise without departing from such principles. For example, one skilled in the art will readily recognize from such discussion and from the accompanying drawings and claims that various changes, modifications and variations can be made therein without departing from the spirit and scope of the invention as described in the following claims.

What is claimed:

1. A solvent extraction and cleaning system, comprising:

a generally closed product containing vessel having a port for the introduction and extraction of solvent, the vessel being configured to allow introduction and removal of solvent;

a reservoir for storing solvent, the reservoir being connected to the vessel to enable transfer of solvent between the vessel and the reservoir to thereby permit solvent contact with the product within the vessel to clean the product;

a pump for creating a vacuum pressure to evaporate the solvent within the vessel and for withdrawing air from the vessel to thereby dry the product within the vessel; and a controller, the controller regulating the vacuum pressure within the vessel, the controller monitoring the vacuum pressure within the vessel so that at a predetermined vacuum pressure, if the concentration of solvent within the vessel exceeds a predetermined level, the controller temporarily enables gas to enter the vessel to provide a carrier for the evaporated solvent, so as to temporarily reduce the vacuum pressure within the vessel, and the controller then sequentially enables the vacuum pressure to again build within the vessel and then enables the gas to enter the vessel until the concentration of solvent within the vessel is sufficiently low.

2. The apparatus of claim 1 further comprising a first sensor for measuring a concentration of solvent within the vessel, the first sensor providing a first input signal to the controller, the controller enabling gas to enter the vessel partially in accordance with the first input signal.

3. The apparatus of claim 2 further comprising a vacuum sensor for measuring the vacuum pressure within the vessel, the vacuum sensor providing a vacuum signal to the controller, the controller enabling gas to enter the vessel partially in accordance with the vacuum signal.

4. The apparatus of claim 1 further comprising a trap connected between the vessel and the pump for recovering solvent in a liquid state from solvent in a gaseous state.

5. The apparatus of claim 4 wherein the temperature of contents of the trap are reduced in the trap to facilitate recovery of the solvent.

6. The apparatus of claim 1 further comprising a separator connected to an output of the pump and receiving exhaust from the pump output, the separator separating solvent components from the exhaust.

7. The apparatus of claim 6 further comprising a carbon filter which receives output gas from the separator, the carbon filter removing solvent components from the gas.

8. The apparatus of claim 7 further comprising a second sensor for detecting solvent in output from the carbon filter, the second sensor providing a second input signal to the controller.

* * * * *